US005357897A

United States Patent [19]

Bailey

[11] Patent Number: 5,357,897

[45] Date of Patent: Oct. 25, 1994

[54] DISTANCE MARKER WITHIN A GOLF COURSE FAIRWAY

[76] Inventor: John M. Bailey, 1249 Golfside Dr., Sebring, Fla. 33870

[21] Appl. No.: 204,982

[22] Filed: Mar. 2, 1994

[51] Int. Cl.[5] ..... G09F 19/00

[52] U.S. Cl. ..... 116/209; 273/176 A; 40/608

[58] Field of Search ..... 40/608; 52/103, 105; 116/209; 273/176 A, 176 L; 404/9, 10, 11

[56] References Cited

U.S. PATENT DOCUMENTS

| | | | |
|---|---|---|---|
| 1,903,869 | 4/1933 | Meister et al. | 40/608 |
| 3,599,981 | 4/1972 | Zausmer | 52/103 X |
| 4,343,567 | 8/1982 | Sarver et al. | 404/10 |
| 4,522,530 | 6/1985 | Arther | 404/10 |
| 4,649,678 | 3/1987 | Lamson | 52/103 |
| 4,862,823 | 9/1989 | Hughes | 116/209 |
| 4,926,785 | 5/1990 | Lamson | 116/209 |
| 5,072,940 | 12/1991 | Bailey | 273/176 A |
| 5,114,149 | 5/1992 | Bailey | 273/176 A |
| 5,215,033 | 6/1993 | Gipp et al. | 116/209 |
| 5,230,297 | 7/1993 | Lakatos | 116/209 |

*Primary Examiner*—William A. Cuchlinski, Jr.
*Assistant Examiner*—Willie Morris Worth
*Attorney, Agent, or Firm*—Charles J. Prescott

[57] ABSTRACT

A visual distance marker for a golf course fairway and method which provides viewable indicia of distance along the fairway such as from a tee. The device includes an elongated resilient preferably elastomeric or polyurethane marker tube having its lower end slidably or adhesively secured inside a tubular anchor member. When the anchor member is implanted or buried in the ground, the marker tube is supported in an upright orientation extending above the ground, being supported inside the tubular anchor member. The marker tube is sufficiently resilient in all directions so as to be deflected and bent over against the ground as a reel-type lawn mower approaches and passes thereover, thus eliminating the need for removing and replacing the device during normal mowing operations.

2 Claims, 1 Drawing Sheet

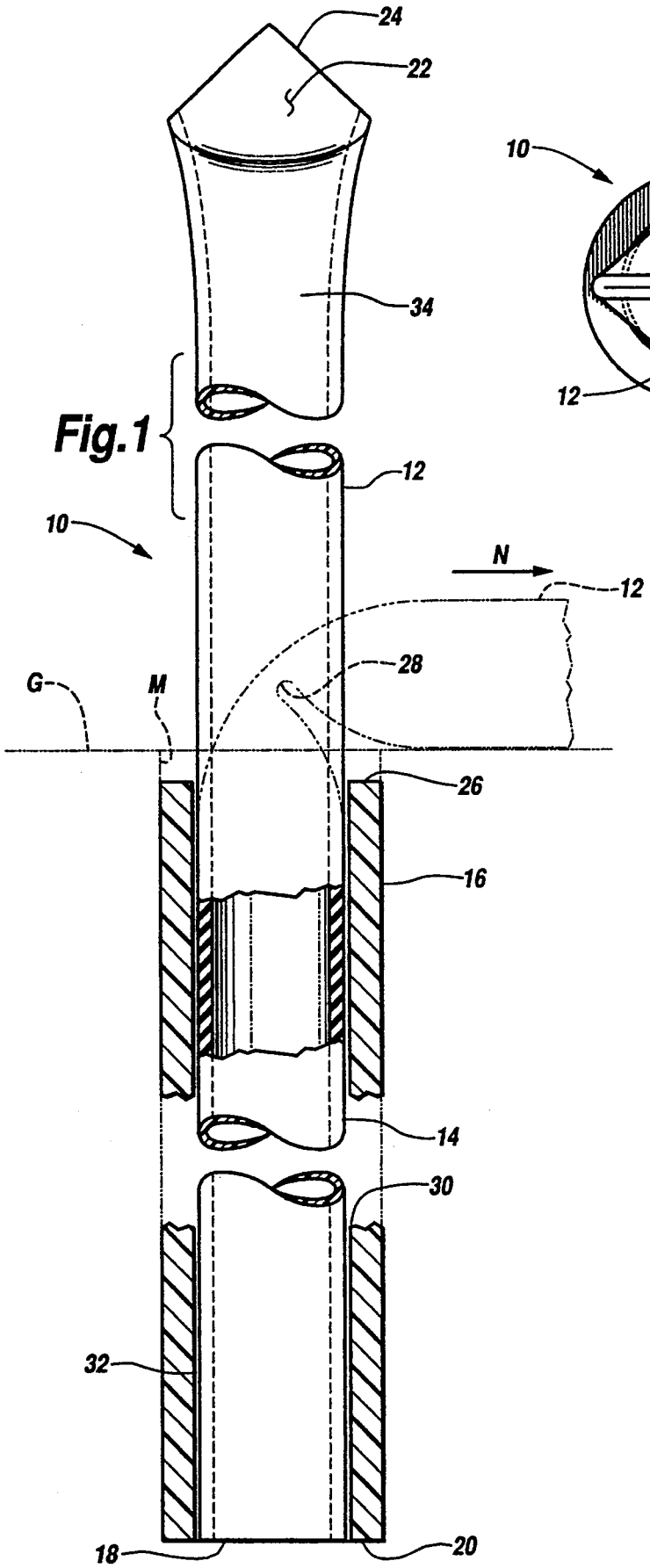
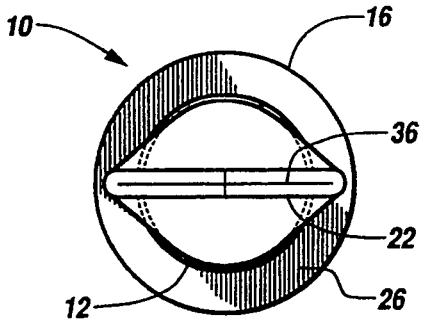
Fig.2

DISTANCE MARKER WITHIN A GOLF COURSE FAIRWAY

BACKGROUND OF THE INVENTION

1. Field of the Invention

This invention relates generally to viewable marking devices, and more particularly to a resilient viewable distance marker for use in golf courses along the length of a fairway.

2. Prior Art

Knowing the distance of a golf ball from a particular position on a fairway after being struck from a tee is quite important in the game of golf. This information not only provides the golfer with feedback as to the length of his initial drive from the tee, but also provides immediate information as to the distance from ball placement to the green of that particular fairway. When it is likely that, on the golfer's next shot, he will reach the green, this information becomes of even more importance.

One device known to applicant which serves this function is in the form of a concrete disc buried in the ground flush with the ground's surface so that mowing machines may pass thereover without damage. Other objects used for this purpose are stakes or shrubbery planted on each side of the fairway in the rough away from normal mowing operations.

These above devices are unsatisfactory for their intended use. The concrete discs are difficult to see from any distance and typically result in delay of the game as a player searches for the marker. Likewise, shrubbery and stakes planted in the rough are often damaged or knocked down despite careful mower operator avoidance maneuvers.

Applicant is also aware of one prior art device disclosed in U.S. Pat. No. 3,067,717 to Imparato which teaches a portable resilient marker having a coiled spring member positioned just above the ground level as a lower extension thereof is embedded in the ground. However, this device would clearly become damaged or destroyed the first time that a fairway mower passes over it. Therefore, this device would require removal during normal mowing operations.

Based upon the prosecution of the above-referenced continuation-in-part application, applicant is also aware of the following references which were cited during that prosecution:

| | |
|---|---|
| Kirk | 2,774,323 |
| Pellowski | 3,362,305 |
| Neaume | 4,696,134 |
| Hughes | 4,862,823 |

However, none of these references perform a function or have structure which is similar to that of the present invention.

Confronted with this problem, and being aware that a reel-type mower in either single or gang form is used for fairway mowing, applicant's two previous inventions were intended to provide a device which clearly satisfies this need and takes advantage of the inherent structural features of these reel-type mowers. A visual distance marker was provided as disclosed in U.S. Pat. Nos. 5,072,940 and 5,114,149 which is implanted or buried within the ground on the fairway having an upwardly extending marker strip which is of sufficient width, when placed generally transversely to the length of the fairway, so as to be viewable by a golfer from a significant distance therefrom. Additionally, the marker strip, being resilient in one direction because of its thinness, will be resiliently deflected downwardly against the ground as the mower is passed thereover and then returning to its generally upright position thereafter without damage or the need for removal.

The present invention represents an improvement over prior art, including my previous two referenced U.S. patents. The present invention provides a resilient, tubular marker tube which extends downwardly into the tubular anchor member implanted in the ground and upwardly above the ground a distance sufficient for a golfer to view same from a useful distance. Through the utilization of preferred resilient elastomer or polyurethane marker tube in lieu of the flat plastic marker strips of my previous patents, the present invention is virtually unaffected by mowing operations, regardless of the mowing direction of the fairway.

BRIEF SUMMARY OF THE INVENTION

This invention is directed to a visual distance marker for a golf course fairway which provides viewable indicia of distance along the fairway such as from a tee. The device includes an elongated resilient, preferably elastomeric or polyurethane marker tube having its lower end slidably or adhesively secured inside a tubular anchor member. When the anchor member is implanted or buried in the ground, the marker tube is supported in an upright orientation extending above the ground, being supported inside the tubular anchor member. The marker tube is sufficiently resilient in all directions so as to be deflected and bent over against the ground as a reel-type lawn mower approaches and passes thereover, thus eliminating the need for removing and replacing the device during normal mowing operations.

It is therefore an object of this invention to provide a visual distance marker for golf course fairways which may be embedded or buried in the ground without the need for removal during normal mowing operations.

It is yet another object of this invention to provide a visible distance marker for golf course fairways which is easily viewable from a considerable distance so that it may quickly located during normal golf play.

It is yet another object of the above invention to be economical to manufacture and easily deployable into the fairway at any desired location.

It is yet another object of this invention to provide an upright viewable indicia strip which bears distance indicia either from a golf tee and/or to the next associated green or hole.

It is still another object of this invention to provide a visible distance marker for golf course fairways which will resiliently deflect and return to an upright position regardless of the angle of fairway mowing.

In accordance with these and other objects which will become apparent hereinafter, the instant invention will now be described with reference to the accompanying drawings.

BRIEF DESCRIPTION OF THE DRAWINGS

FIG. 1 is a side elevation partially broken view of the preferred embodiment of the invention.

FIG. 2 is a top plan view of FIG. 1.

DETAILED DESCRIPTION OF THE INVENTION

Referring now to the drawings, the invention is shown generally at numeral 10 and includes an elongated, tubular, resilient, elastomeric marker tube 12 fabricated of an extruded thermoplastic rubber material. The preferred source for this tubular elastomeric material is under the trademark "SANTROPENE #221-73" available from Advanced Elastomer Systems of Akron, Ohio. This elastomer has a Shore A hardness of 73 with good fluid resistance. Although it is preferred that the elastomeric material purchased in bulk be extruded to form the tubular structure of the marker tube 12, this material may also be blow molded, injection molded or utilizing other melt processing techniques. Other suitably resilient polymer type materials such as polyurethane may also be used to manufacture the marker tube 12.

This marker tube 12 is slidably connected in upstanding orientation within a rigid plastic or p.v.c. cylindrical tube 16. The marker tube 12 is sized in diameter so as to be snugly slid into the tubular anchor member 16 so that its lower end 18 will be generally in alignment with the lower end 20 of the anchor member 16.

In the preferred embodiment, the marker tube 12 will remain securely in place during moving operations by sliding frictional fit within the anchor member 16. This is enhanced by the somewhat textured surface afforded by the "SANTROPENE" elastomeric material. This sliding friction fit also facilitates easy replacement of the marker tube 12 without removal of the anchor member 16 from the ground G.

However, should additional securement of the marker tube 14 be required for any reason, a band of bonding material 32 may be applied around the lower portion 14 of the marker tube 12 to permanently secure this arrangement within anchor member 16.

It is recommended that the device 10 be installed into a fairway of a golf course by first drilling a hole M slightly deeper than the length of anchor member 16 so that the upper end 26 will be positioned slightly below the grade level G of the fairway. When so installed, as a reel-type lawn mower passes over the device 10, the exposed above-ground portion of the marker tube 12 is deflected downwardly as shown in phantom in FIG. 1. Typically, these lawn mowers used on golf course fairways include a cutting reel having a plurality of spiral-wound bars or blades which rotate in the direction of forward movement. The reel is positioned slightly behind a transversely oriented leading edge bar or roller which first comes in contact with, and downwardly deflects, the marker tube 12.

As shown in phantom in FIG. 1, then, as the lawn mower (not shown) passes in the direction of and over the device 10, the marker tube 12 is bent or kinked at 28 so that the exposed portion of the marker tube 12 lays flat against the ground as shown in phantom. Additional flattening of the tube material may also occur for reduced overall height. Because of the resiliency of the above-referenced elastomeric material, the marker tube 12 will immediately return to a generally straight upright orientation after the lawn mower has passed thereover.

By the utilization of a thermoplastic elastomer such as "SANTROPENE", the upper end 22 of the marker tube 12 may be flattened and heat sealed at 22 as shown so as to sealingly close the upper exposed end of the marker tube 12. After heat sealing into a flattened condition at 22, diagonal cuts at 24 provide a pointed upper end for enhanced viewability.

This thermoplastic elastomer or rubber material may be provided in various colors or may be paint coated. It is preferred that specific colors be utilized to represent a common distance from a tee of each fairway. Thus, for example, a blue colored marker tube would be associated with a 200 yard marker, while a yellow colored marker tube may be associated with a 100 yard distance from the tee or distance to the green, and so forth. This color designation would then be made universal for at beast each golf course and, preferably, made widely universal for all golf courses utilizing the present invention so that golfers would come to know and easily recognize this color scheme.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus, articles and materials.

What is claimed is:

1. A visual distance marker for a golf course which is implanted in an elongated fairway of the golf course and is materially unaffected by the operation of a reel-type lawn mower passing thereover, said marker consisting of:

a tubular, generally straight, resilient upstanding marker tube having an upper distal end and a lower end and a uniform generally cylindrical cross section along substantially its entire length;

an elongated, straight upright, rigid tubular anchor member completely embedded into a grassy area of the golf course fairway, said anchor member having a length generally in the range of less than half the length of said marker tube, said marker tube having an outside diameter slightly less than an inside diameter of said anchor member;

said marker tube slidably engagable into said anchor member whereby their lower ends are aligned one to another;

said marker tube extending above ground a distance such that said marker tube may be initially depressed by a leading edge bar of the lawn mower and said marker tube will be subsequently depressed by the mower and rolling bar of the mower, so that said marker tube will not be severed when the grassy area of said fairway is being mowed in any direction across said fairway, said marker tube being sufficiently resilient to return to its original straight and upstanding orientation thereafter;

said marker tube extending above the ground having a particular color indicia thereon for viewably communicating to a golfer the distance of said marker tube from a green associated with said fairway.

2. A method of marking distance along a fairway of a golf course from a tee of the fairway comprising the steps of:

(a) implanting a visual distance marker in the fairway at predetermined distances from the tee, said visual distance marker being unaffected by the operation of a reel-type lawn mower passing thereover; said visual distance marker consisting of:

a tubular, generally straight resilient upstanding marker tube having an upper distal end and a lower end and a uniform generally cylindrical cross section along substantially its entire length;

an elongated, straight upright, rigid tubular anchor member completely implanted into a grassy area of the golf course fairway, said anchor member having a length generally in the range of less than half the length of said marker tube, said marker tube having an outside diameter slightly less than an inside diameter of said anchor member;

said marker tube slidably engagable into said anchor member whereby their lower ends are aligned one to another;

said marker tube extending above ground a distance such that said marker tube may be initially depressed by the leading edge bar of the lawn mower and said marker tube will be subsequently depressed by a mower and rolling bar of the mower, so that said marker tube will not be severed when the grassy area of said fairway is being mowed in any direction across said fairway, said marker tube being sufficiently resilient to return to its original straight and upstanding orientation thereafter;

said marker tube extending above the ground having a particular color indicia thereon for viewably communicating to a golfer the distance of said marker tube from a green associated with said fairway;

(b) identifying each color indicia with the corresponding known distance whereby each golfer is familiar with the distance significance of each color indicia.

* * * * *